US005441138A

United States Patent [19]

Hird et al.

[11] Patent Number: 5,441,138

[45] Date of Patent: Aug. 15, 1995

[54] COIN HANDLING SYSTEM WITH AN IMPROVED COIN CHUTE

[75] Inventors: John A. Hird, Dallas; Mark E. Kerr, Wylie, both of Tex.

[73] Assignee: Intellicall, Inc., Carrollton, Tex.

[21] Appl. No.: 200,481

[22] Filed: Feb. 23, 1994

Related U.S. Application Data

[63] Continuation of Ser. No. 841,379, Feb. 25, 1992, Pat. No. 5,388,680, which is a continuation-in-part of Ser. No. 594,272, Oct. 9, 1990, Pat. No. 5,090,548.

[51] Int. Cl.[6] ..... G07F 1/04

[52] U.S. Cl. ..... 194/345; 194/349

[58] Field of Search ..... 194/349, 348, 347, 345, 194/346, 321, 323, 203

[56] References Cited

U.S. PATENT DOCUMENTS

| | | | |
|---|---|---|---|
| 1,317,953 | 10/1919 | Bodmer | 194/344 |
| 1,711,049 | 4/1929 | Fonda et al. | 194/345 |
| 2,277,018 | 3/1942 | Patzer et al. | 194/323 |
| 2,292,472 | 8/1942 | Patzer et al. | 194/326 |
| 2,298,009 | 10/1942 | Grunig | 194/325 |
| 2,904,151 | 9/1959 | Johnson | 194/220 |
| 3,030,008 | 4/1962 | Jensen | 232/57.5 |
| 3,337,125 | 8/1967 | Nielsen | 232/57.5 |
| 3,372,864 | 3/1968 | Kovar | 232/57.5 |
| 3,810,575 | 5/1974 | Breitung et al. | 232/57.5 |
| 4,211,317 | 7/1980 | Bellis | 194/346 |
| 4,410,077 | 10/1983 | Okolischan | 194/344 |
| 4,687,090 | 8/1987 | Ramseier | 194/317 |
| 4,842,120 | 6/1989 | Dobbins et al. | 194/349 |

FOREIGN PATENT DOCUMENTS

| | | | |
|---|---|---|---|
| 3345149 | 6/1985 | Germany | 194/348 |
| 2-76093 | 3/1990 | Japan | 194/348 |

*Primary Examiner*—F. J. Bartuska
*Attorney, Agent, or Firm*—Baker & Botts

[57] ABSTRACT

A coin handling system comprising an improved coin chute (115) for guiding coins in a coin operated machine is provided comprising a first chute piece (122) and a second chute piece (123), each forming an opposite sidewall of the chute (115). An internal bevelled surface (129) is formed on the backwall (140) of one of the chute pieces (122, 123) so that foreign objects forced into the chute (115) and impacting the backwall (140) will cause the chute (115) to separate into the chute pieces (122, 123) and thereby cause the foreign object to leave the chute (115). Additionally, external bevelled surfaces (144, 148) are formed on the chute pieces (122, 123) so that if a foreign object impacts the outside of the chute (115), the chute (115) separates 15 into the chute pieces (122, 123) and allows continued movement of the foreign object. Thus, the foreign object does not become caught in the coin chute (115). In another aspect of the invention, ridges (130) are formed on the backwall (140) of the chute (115). These ridges (130) obstruct and inhibit downward movement of foreign objects that have been forced into the chute (115) and that impact the backwall (140).

6 Claims, 5 Drawing Sheets

COIN HANDLING SYSTEM WITH AN IMPROVED COIN CHUTE

This application is a continuation of U.S. application Ser. No. 07/841,379, filed Feb. 25, 1992, by John A. Hird and Mark E. Kerr and entitled "Coin Handling System with an Improved Coin Chute", now U.S. Pat. No. 5,388,680, issued Feb. 14, 1995, which is a continuation-in-part of U.S. application Ser. No. 07/594,272, filed Oct. 9, 1990, by John A. Hird and Mark E. Kerr and entitled "Coin Handling System", now U.S. Pat. No. 5,090,548 issued Feb. 25, 1992.

TECHNICAL FIELD OF THE INVENTION

This invention relates in general to the field of coin handling systems and more particularly to a coin handling system having an improved coin chute for use in coin operated machines.

BACKGROUND OF THE INVENTION

Jammed coin handlers present a serious problem for coin operated machines. For example, it is estimated that 80% of service calls for pay telephones are to repair jammed coin handlers within the telephones. In pay telephones, the coin handlers are typically jammed by thieves who stuff matchbooks, partially inflated balloons or other foreign objects into the coin chute. These foreign objects cause the coin chute to fill up with coins as pay telephone callers unsuccessfully attempt to use the telephone. The thief retrieves these coins by pushing a coat hanger, a dipstick or other similar object into the coin chute, thereby forcing the coins through an adjacent coin validator and into a coin return slot.

Alternatively, the thief retrieves the coins by inserting a coat hanger, a dipstick or another similar elongated object with a hook-type device at its end into the coin chute and drawing the lodged coins out through the coin slot with the hook-type device. When hook-type objects are forced into a coin chute, they often become caught in the chute. This may lead to breakage of the chute if the thief attempts to forcibly retrieve the caught foreign object.

Intentional jamming of coin handlers causes significant revenue loss to owners of coin operated machines. In addition, thieves and vandals often cause serious damage to coin operated machines by forcing foreign objects into coin validators and other internal mechanisms of the coin machines.

Accordingly, a need has arisen for a coin handling system that prevents the intentional or accidental jamming of a coin operated machine and that safeguards the machine from potential damage from attempts to jam the machine. Further, there is a need for a coin handling system that prevents hook-type devices from becoming caught on coin chutes, thereby preventing damage to the coin chute that would occur if attempts were made to forcibly retrieve a caught hook-type device.

SUMMARY OF THE INVENTION

In accordance with the teachings of the present invention, a coin handling system is provided that prevents the jamming of foreign objects and coins in coin operated machines and prevents foreign objects forced into the machines from entering and damaging coin validators and other internal mechanisms of the machines.

The coin handling system of the present invention comprises a coin chute that can be divided into two separate pieces to clear coins and other objects lodged in the chute. The coin chute can easily be cleared by a "sweep and clear" mechanism. When a coin release lever outside the machine is actuated, the coin chute rotates from its biased rest position, usually above the entry to an electronic coin validator, to a position above a trash and coin return chute. When it is at this second position, the coin chute separates, releasing the lodged coins and foreign objects.

An important technical advantage of the present invention is that it prevents theft by intentional jamming of coin operated machines. If foreign material is lodged into the chute by a thief to block the passage of and to collect coins inserted by later users, the foreign material can be easily cleared by activating the "sweep and clear" operation of the invention. No coins will accumulate for the thief. A further technical advantage of the present invention is that activation of the "sweep and clear" operation also activates a clearing mechanism in the coin validator so that the coin validator can be simultaneously cleared.

According to another aspect of the invention, ridges are integrated in the inner side surfaces of the coin chute. These ridges tend to trap foreign material in the upper portions of the chute, preventing the foreign material from traveling further along the coin path. These ridges also prevent wet coins from sticking to the inner surfaces of the coin chute.

According to further aspects of the present invention, features are included to prevent foreign objects like coat hangers and dip sticks from entering and damaging coin validators and other internal mechanisms of coin operated machines. First, the coin chute may comprise a multidirectional shape such that coins or other objects attempting to pass through the chute must change directions and consequently impact a wall of the chute. According to one embodiment of the present invention, the multidirectional shape comprises an L-shape such that foreign object cannot be guided through the chute without impacting a back wall of the chute near the single bend in the chute. Additionally, the back end of the coin chute may comprise several slots. When a dip stick, a coat hanger or other similar object is forced into the chute, the slots deflect the object through them rather than allowing the object to go further into the chute. In another aspect of the invention, the interior rear edge of one of the two pieces that forms the chute is bevelled. When an object like a dip stick is forced against the bevelled area, the chute separates and causes the object to leave the chute rather than travel down the chute into the internal mechanisms disposed below the chute. These elements of the invention prevent foreign objects from entering and damaging coin validators and other internal mechanisms of coin operated machines.

According to another aspect of the invention, ridges are integrated into the backwall of the chute. These ridges inhibit downward movement of foreign objects that are forced into the coin chutes and against the coin chute backwall.

According to another aspect of the invention, the chute pieces forming the coin chute are provided with external bevelled surfaces. If a foreign object with a hook at its end is forced into the chute, the chute initially separates as the foreign object impacks the previously described internal bevelled surface, causing the foreign object to harmlessly move out of the chute. Then, if the thief attempts to withdraw the foreign object, the foreign object impacts the external bevelled surface, causing the chute to reopen and allowing the thief to remove the object. Because of the external bevelled surface, no damage is done to the chute as the foreign object does not become hooked to any outside edge of the coin chute.

BRIEF DESCRIPTION OF THE DRAWINGS

The objects and advantages of the present invention are more readily apparent when the following detailed description is read in conjunction with the accompanying drawings, wherein.

DETAILED DESCRIPTION OF THE INVENTION

Figure 1:
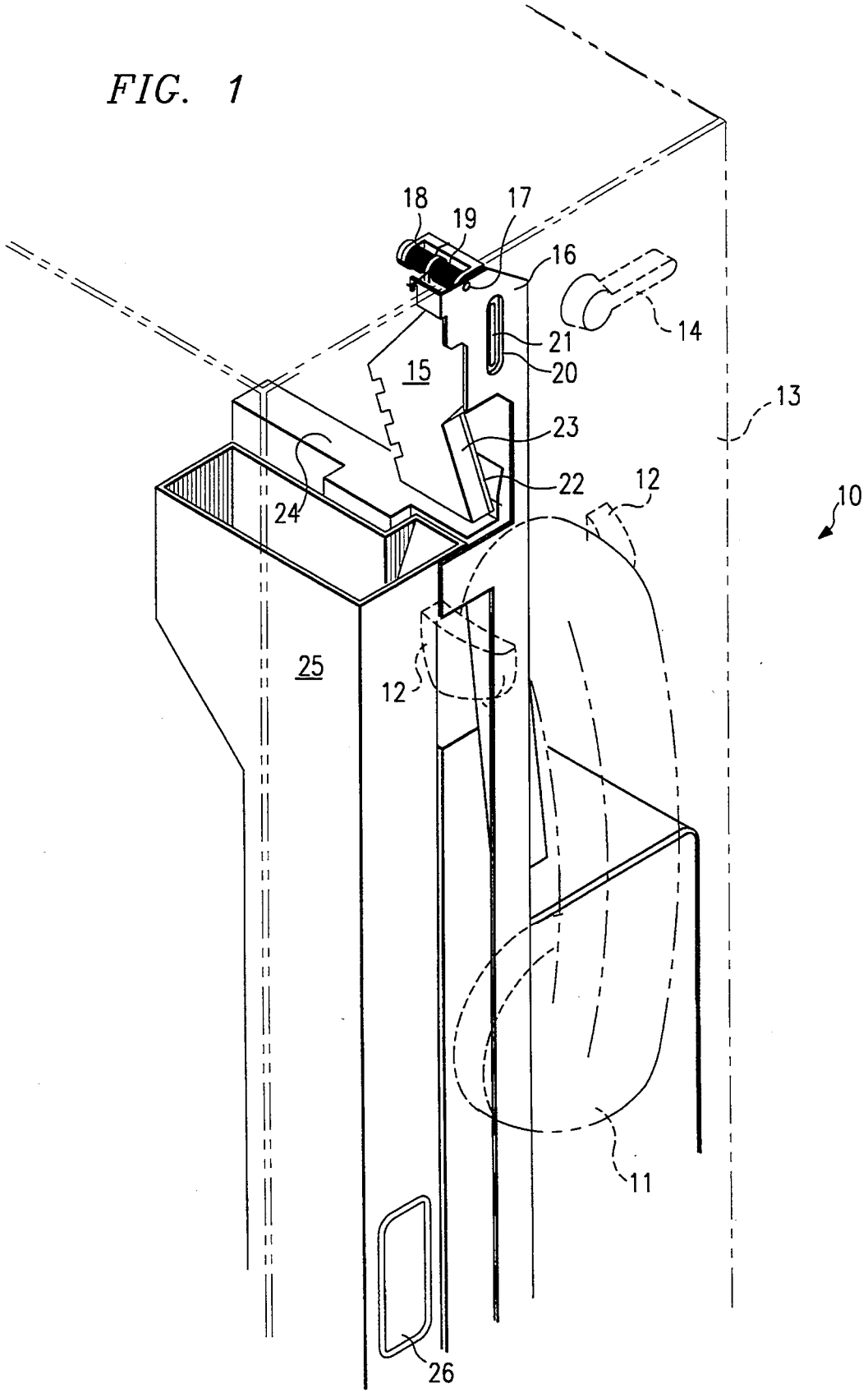
FIG. 1 is a three dimensional view showing the location and position of a coin handling system in a pay telephone.

FIG. 1 shows an embodiment of the present invention as it may be used in a generally indicated pay telephone 10. Pay telephone 10 comprises a receiver 11 which, when not in use, is placed on a cradle 12. Cradle 12 is mounted to the outside of a chassis 13. A coin release lever 14 is pivotally connected to the outside of chassis 13. Coin release lever 14 is connected by a linkage (not shown) to a coin chute 15. The top of coin chute 15 is pivotally connected to a bracket 16, which is mounted on the inside of chassis 13. A pivot pin 17 is used to connect coin chute 15 to bracket 16. A first biasing spring 18 and a second biasing spring 19 are wound around pivot pin 17. A first coin slot 20 is formed in bracket 16. A second coin slot 21 is aligned with first coin slot 20 when the coin chute 15 is in a rest position and forms the entry to coin chute 15.

Coin chute 15 comprises a first chute piece 22 and a second chute piece 23. First and second chute pieces 22 and 23 are biased together by first biasing spring 18. Coin chute 15 is biased into a vertical position by second biasing spring 19. When in its vertical position, coin chute 15 is disposed directly above the entry to a coin validator 24, which is also mounted on the bracket 16. Coin validator 24 may comprise, for example, an "MS16" model coin validator manufactured by Mars Electronics. Coin validator 24 functions to electronically detect counterfeit coins as well as to determine the value of coins inserted by a patron. It should be understood that while the preferred embodiment comprises an electronic coin validator, any type of coin validator may be used to determine the value of coins deposited including those functioning mechanically or optically.

Coin validator 24 selectively routes coins to a coin box (not shown) or a coin return box 26. The internal mechanisms of coin validator 24 can be easily damaged by foreign objects forced through coin validator 24. A trash and coin release chute 25 is positioned adjacent to coin validator 24, such that coin chute 15 can be rotated from its position above coin validator 24 to a position in which its lower end is above trash and coin return chute 25. At the lower end of trash and coin return chute 25 is a coin return box 26, from which a telephone user can retrieve coins and foreign objects that have been jammed in and dislodged from coin chute 15.

Figure 2:
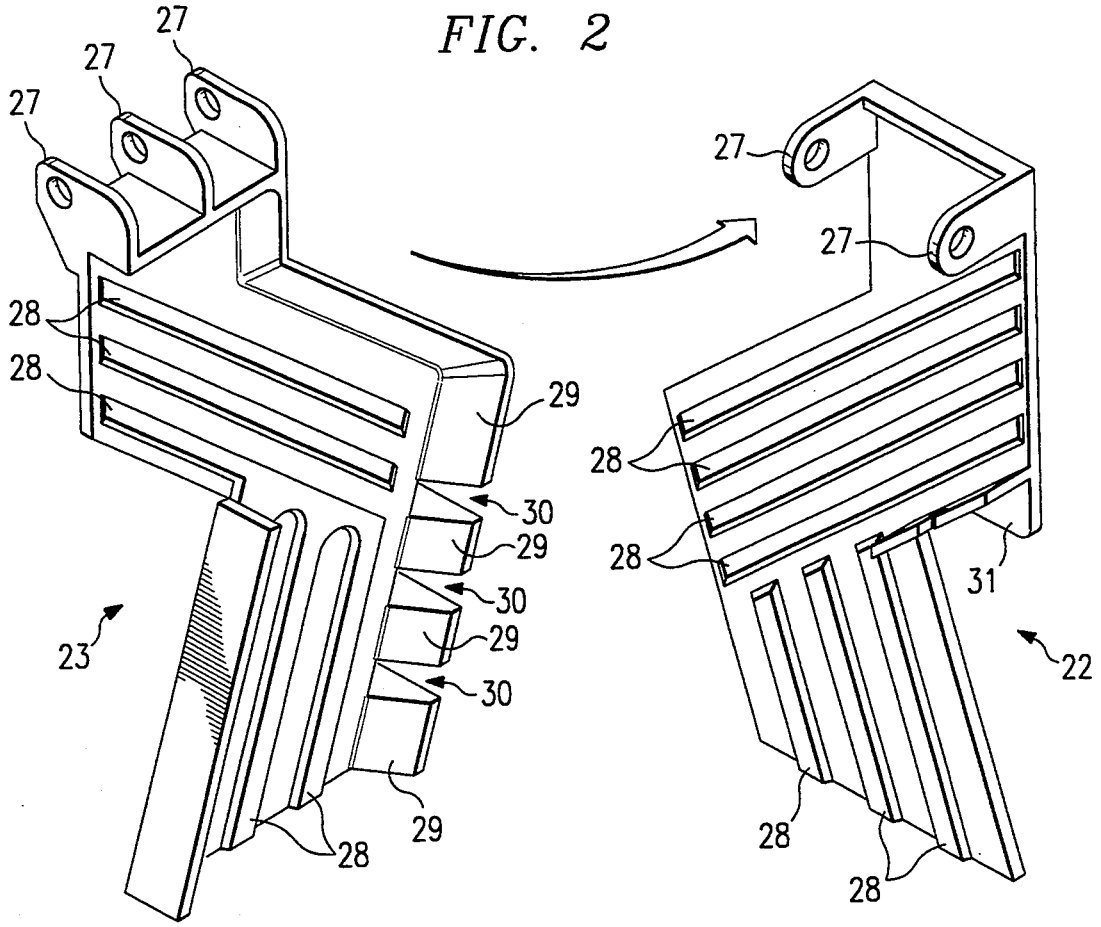
FIG. 2 is an exploded view of One embodiment of the coin chute used in the present invention.

FIG. 2 is an exploded view of coin chute 15, showing first coin chute piece 22 and second coin chute piece 23. Both chute piece 22 and chute piece 23 have pivot pin holders 27 formed at their upper edges. Pivot pin 17 fits in pivot pin holders 27, pivotally coupling first chute piece 22 to second chute piece 23. Both first chute piece 22 and second chute piece 23 also have ridges 28 formed on their interior surfaces. Second chute piece 23 has a bevelled edge 29 formed on its rear edge. Second chute piece 23 also contains slots 30 formed in and generally shown on the rear edge. A stop plate 31 is formed near the center of the front edge of chute piece 22.

When the pay telephone 10 is used normally, the phone user inserts a coin in coin slot 20, which is aligned with coin slot 21 at the entry to coin chute 15. The coin rolls through coin chute 15 and enters coin validator 24, which is directly beneath coin chute 15 when coin chute 15 is in its normal rest position. The coin validator then examines the coin to determine whether it is sufficient to allow the caller to use the phone.

Figure 5:
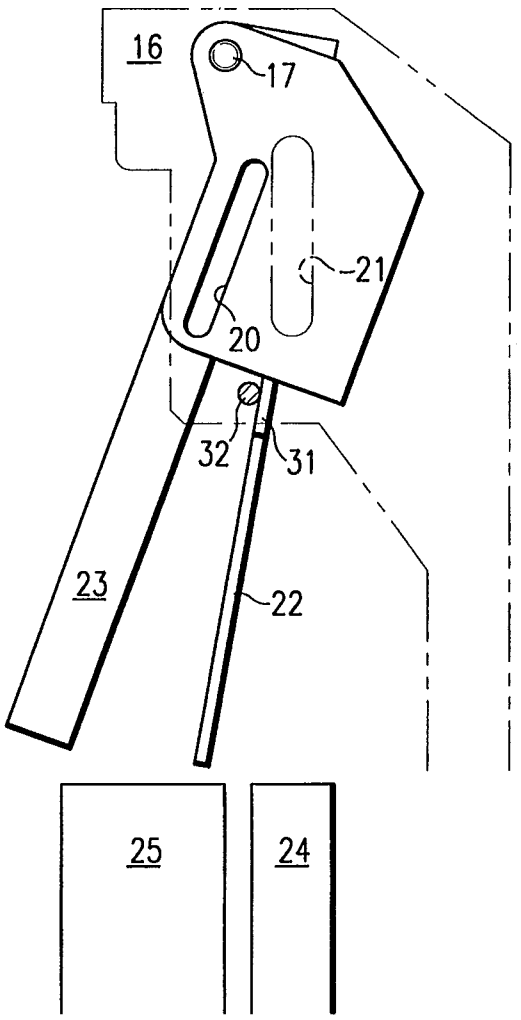
FIG. 3, 4 and 5 are sequential diagrams that illustrate the operation of the invention's "sweep and clear" mechanism.
Figure 4:
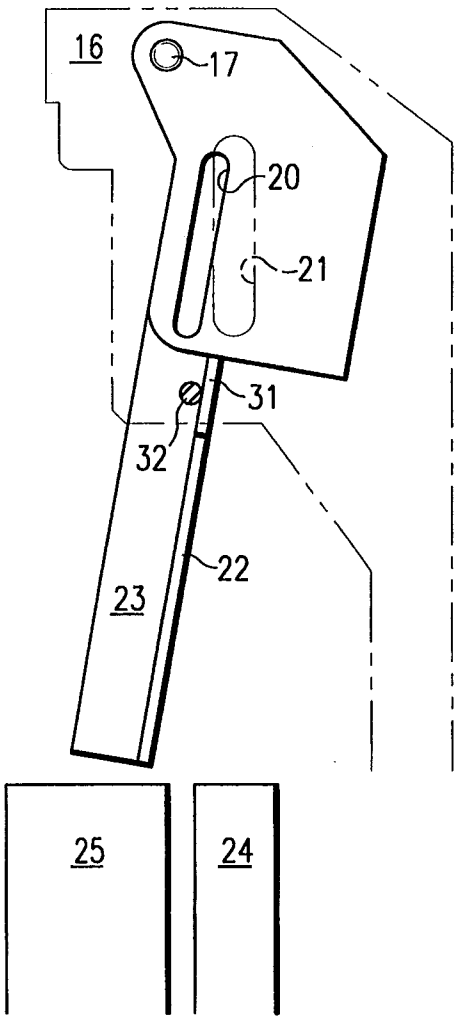
Figure 3:
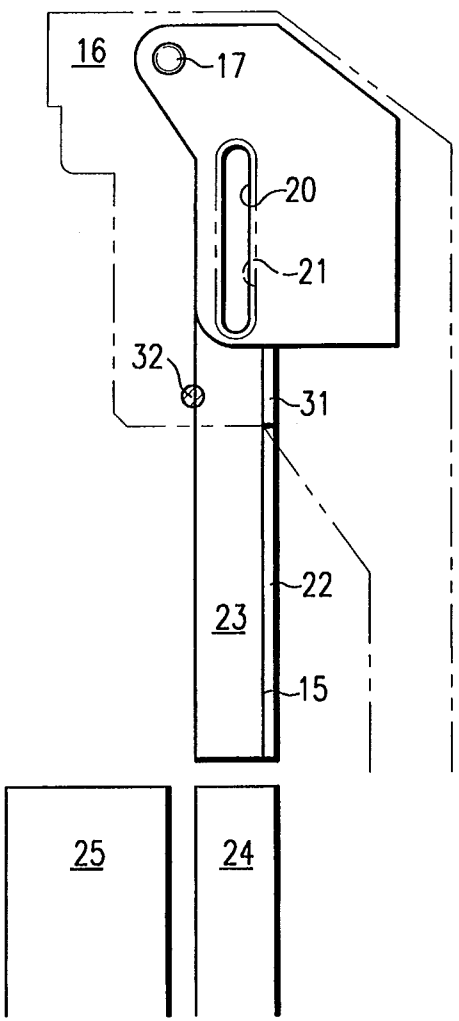

In the event coin chute 15 is jammed with foreign objects or coins, coin chute 15 can be easily cleared by the "sweep and clear" operation of the present invention. FIGS. 3, 4 and 5 are sequential diagrams illustrating the "sweep and clear" operation. FIG. 3 shows a front view of coin chute 15 in its biased vertical rest position in which the bottom end of coin chute 15 is directly above the entry to coin validator 24. Coin chute 15 is biased in this rest position by second biasing spring 19. First coin chute piece 22 and second coin chute piece 23 are biased together to form coin chute 15 by first biasing spring 18.

To activate the sweep and clear operation, the user of pay telephone 10 depresses coin release lever 14. This causes the coin chute 15, which is pivotally connected at its top to bracket 16, to rotate from its rest position to a second position in which the exit end of coin chute 15 is above the trash and coin return chute 25 as shown in FIG. 4. When the coin chute 15 reaches this second position, stop plate 31 of first chute piece 22 engages a stop 32 15 fixed with respect to bracket 16 which prevents first chute piece 22 from further rotation. Second chute piece 23 is unhindered by the stop 32 and rotates away from first chute piece 22 as shown in FIG. 11. When the chute 15 is in this divided position, coins or foreign matter jammed in coin chute 15 are dislodged into the trash and coin return chute 25. When the telephone user releases coin release lever 14, chute 15 closes and rotates back into the biased rest position shown in FIG. 10. Coin release lever 14 is connected to and controls the movement of coin chute 15 by means of a suitable linkage (not shown).

According to another aspect of the present invention, coin validator 24 may itself comprise a clearing system operable to clear foreign objects trapped in the coin path of coin validator 24. For example, the entrance to coin validator 24 may comprise hinged sidewalls (not shown) to allow for the clearing of foreign objects that somehow become jammed in coin validator 24. Through the use of an appropriate linkage (not shown), any clearing features of coin validator 24 can be actuated after coin chute 15 is moved to the position shown in FIG. 3. Accordingly, any foreign objects jammed in coin chute 15 as well as any foreign objects jammed in coin validator 24 may be cleared simultaneously.

An important technical advantage of the present invention inheres in the fact that coin chute 15 comprises a multidirectional shape such that coins passing through chute 15 are forced to change directions during their passage. This shape makes it difficult to negotiate foreign objects such as dipsticks, coat hangers or the like through chute 15 as any such objects will necessarily be forced into a wall of chute 15. Chute 15 is shown comprising an L shape, however, chute 15 may comprise a variety of arcuate or other multidirectional shapes. The general L shape of chute 15 is shown solely for the purpose of teaching the present invention and should not be construed to limit the scope of the present invention to this or any specific embodiment.

An additional technical advantage of the coin handling system of the present invention inheres in the fact that the back edge of chute piece 23 is bevelled. When a foreign object like a coat hanger or dipstick is forced into coin chute 15, due to the multidirectional shape discussed previously, it impacts the bevelled edge 29, causing chute piece 23 to separate from chute piece 22. As a result of this separation, the coat hanger or other object is forced to leave coin chute 15 and prevented from going further into coin chute 15 or into coin validator 24.

The same object is accomplished by the slots 30 located in the back edge of chute piece 23. When a coat hanger, dipstick or similar object is forced into coin chute 15, the slots 30 cause the foreign object to protrude through one of the slots and prevent it from going further into chute 15 or into coin validator 24.

A third aspect of the present invention is the set of ridges 28 formed on the inside surface of chute piece 22 and chute piece 23. Ridges 28 function to trap foreign material in the upper portion of chute 15, preventing such foreign material from passing through chute 15 until the "sweep and clear" operation of the present invention is implemented. Additionally, ridges 28 reduce the surface area of chute 15 that comes into contact with coins and, as a result, prevent wet coins from sticking to the insides of coin chute 15.

These aspects of the present invention prevent intentional jamming of coin handlers and protect the internal mechanisms of coin operated machines from foreign objects that are forced into coin chutes. If a thief jams a foreign object like a matchbook into coin chute 15 in order to prevent passage of coins into coin validator 24, 15 chute 15 can be easily cleared by the invention's "sweep and clear" operation. By depressing coin release lever 14, coin chute 15 can be first moved and then separated into two pieces, allowing the matchbook or other objects to fall out into trash and coin return chute 25. As a result, coins do not accumulate for thieves. The phone 10 is then ready for normal operation.

Other aspects of the present invention protect internal mechanisms like coin validator 24 from foreign objects that may be forced into coin chute 15. Foreign objects forced into chute 15 impact bevelled edge 29, causing first chute piece 22 and second chute piece 23 of chute 15 to separate. As a result, foreign objects are forced to leave chute 15 rather than being allowed to go further into chute 15 or coin validator 24. The same objective is accomplished by slots 30 formed on the rear edge of chute piece 23. Slots 30 cause foreign objects like coat hangers forced into coin chute 15 to protrude one of the slots and leave chute 15 rather than go further into it or coin validator 24. Another aspect of the present invention is the set of ridges 28 formed on the interior surfaces of coin chute 15. These ridges reduce the surface area of chute 15 that comes into contact with coins and, as a result, prevent wet coins from sticking to coin chute 15.

Figure 6:
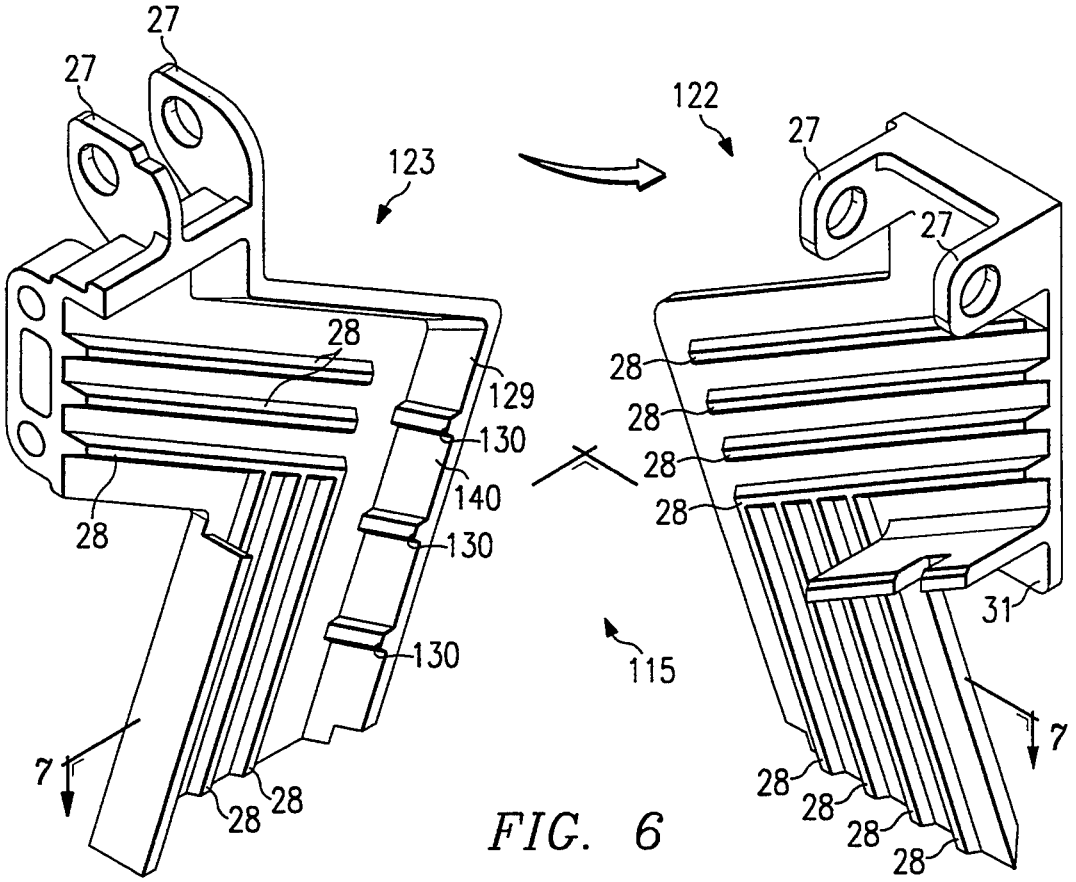
FIG. 6 is an exploded view of a coin chute constructed in accordance with another embodiment of the invention.

FIG. 6 is an exploded view similar to FIG. 2 of a coin chute 115 constructed in accordance with an alternative embodiment of the invention. Coin chute 115 is comprised of a first coin chute piece 122 and a second coin chute piece 123. Like chute pieces 22 and 23 discussed with reference to FIG. 2, chute pieces 122 and 123 each comprise the pivot pin holders 27 and the ridges 28 on their interior surfaces. First chute piece 122 also comprises the stop plate 31.

Second chute piece 123 comprises a backwall 140. The backwall 140 extends from the rest of the second chute piece 123 at an obtuse angle, forming an internal bevelled surface 129. Unlike the chute piece 23, chute piece 123, according to the embodiment shown in FIG. 6, does not comprise the slots 30 on the backwall 140. A plurality of ridges 130, however, are formed on the backwall 140. In operation, when foreign objects like coat hangers are forced into the coin chute 115, the foreign objects impact the ridges 130 on the backwall 140. The ridges 130 thereby obstruct and inhibit downward movement of the foreign objects.

According to another embodiment of the present invention, the ridges 130 may be replaced by a plurality of grooves (not shown) formed into the backwall 140. In operation, when foreign objects like coat hangers are forced into the coin chute 115, the foreign objects impact the grooves on the backwall 140. The grooves engage the foreign objects and thereby inhibit their downward movement.

Figure 7:
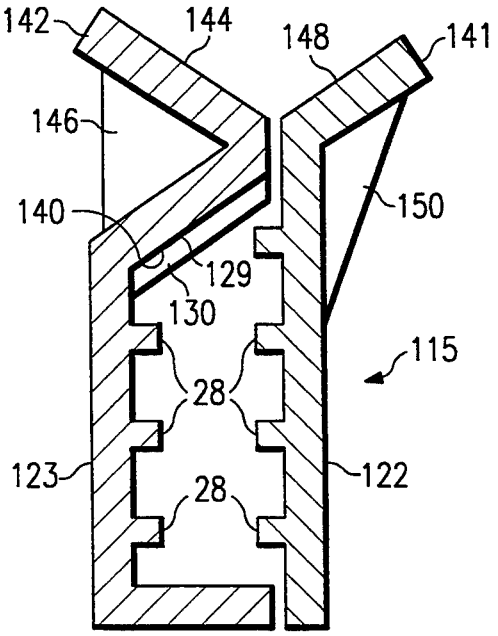
FIG. 7 is a sectional view taken generally along lines 7—7 of FIG. 6.

FIG. 7 is a cross-sectional view of coin chute 115 taken generally along the lines 7—7 shown in FIG. 6, illustrating the additional external bevelled surface feature of the invention. The chute pieces 122 and 123 are shown in FIG. 7 as they are biased together. As FIG. 7 shows, first chute piece 122 comprises a first wing member 141 and second chute piece 123 comprises a second wing member 142. Note that the wing members 141 and 142 are not visible in the view of the chute pieces 122 and 123 shown in FIG. 6 because of the particular angle at which the chute pieces 122 and 123 are illustrated.

The second wing member 142 is integral with the second chute piece 123 along the entire length of the backwall 140. The second wing member 142 extends from the backwall 140 at an angle, thereby forming an external bevelled surface 144. The connection of the second wing member 142 to the backwall 140 may be strengthened or supported by, for example, a plurality of vertically spaced support ribs 146, which extend perpendicular to the backwall 140 across the space between the backwall 140 and the wing member 142 and are integral with the backwall 140 and the wing member 142.

The first chute piece 122 comprises the first wing member 141, which extends at an angle from the rest of the chute piece 122, forming a second external bevelled surface 148. Like the second wing member 142, the connection of the first wing member 141 to the rest of the chute piece 122 may be strengthened or supported by a set of support ribs 150.

When the chute pieces 122 and 123 are in a joined position as shown in FIG. 7, the external bevelled surface feature of the present invention is apparent. It should be noted that the external bevelled surfaces 144 and 148 are integral with the exterior of the chute 115. The bevelled surfaces 144 and 148 are not exterior to the coin operated machine, in which the chute 115 is mounted.

As will be described with reference to FIG. 12, the bevelled surfaces 144 and 148 allow foreign objects with hook-like features that have been forced to move through the coin chute 115 to reenter without becoming caught on one of the edges of the chute 115. The foreign object can thus be removed without breaking or otherwise damaging the chute 115.

Support ribs 146 and 150 may be omitted if the wing members 141 and 142 are relatively small in size. The wing members 141 and 142 should be sufficiently large, however, so that commonly used hooks on the foreign objects do not become caught on the far edges of the wing members 141 and 142. The size of the wing members 141 and 142 may, however, have to be restricted because of space limitations within the coin operated machine.

FIGS. 8 through 11 show cross-sectional views of coin chutes similar to chute 115 constructed in accordance with alternative embodiments. The views shown in FIGS. 8 through 11 are included for the purpose of showing various alternative designs for the external bevelled edge feature of the invention. It should be noted that like reference characters denote like parts in all figures.

Figure 8:
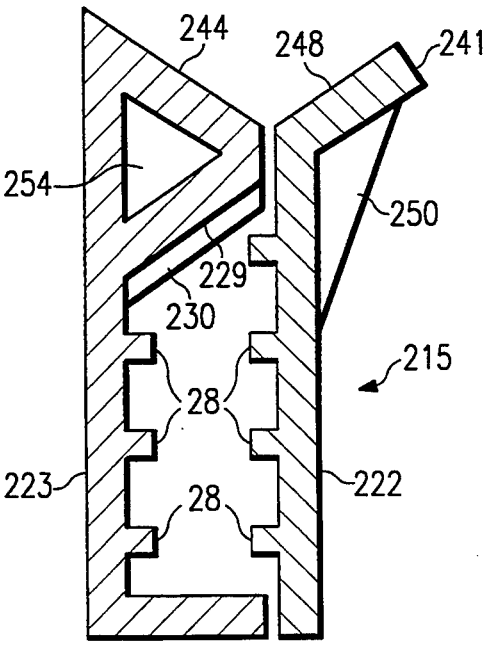
FIGS. 8 through 11 are further sectional views of chutes constructed in accordance with further embodiments of the invention.

In FIG. 8, a coin chute, indicated generally at 215, is shown comprising chute pieces 222 and 223. The rear portion of the chute piece 223 resembles a triangle in the cross-sectional view. One side of the triangle forms an internal bevelled surface 229. A second side of the triangle forms an external bevelled surface 244. The third side of the triangle is aligned and integral with the exterior side wall of the chute piece 223. To reduce material costs, the triangular portion may comprise a hollow portion 254 formed near its center. Ridges 230, similar to the ridges 130 shown in FIG. 6 are formed on the bevelled surface 229.

The first chute piece 222 is similar to the first chute piece 122 shown in FIG. 7. The first chute piece 222 comprises a first wing member 241, which extends outwardly from the rest of the chute piece 222, forming an external bevelled surface 248. The connection of the first wing member 241 to the rest of the first chute piece 222 may be supported by a plurality of support ribs 250, which are similar to the ribs 150 shown in FIG. 7.

A technical advantage of the second chute piece 223 is that it is particularly resistant to breakage as the external bevelled surface 244 is continuously supported by the triangular structure.

Figure 9:
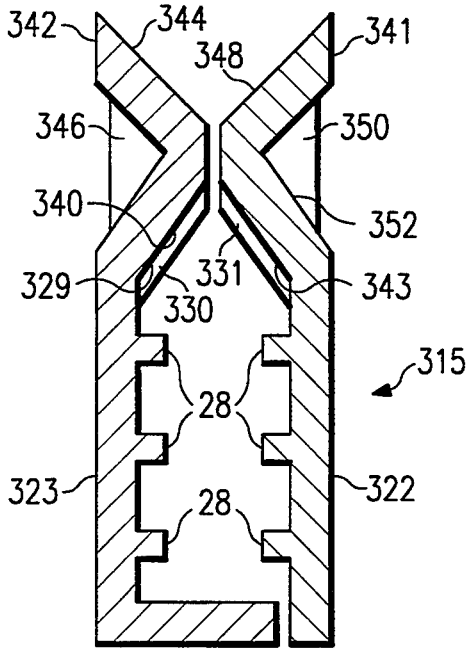

The coin chute 315 shown in FIG. 9 comprises first and second chute pieces 322 and 323. The second chute piece 323 comprises an angled backwall portion 340, forming an internal bevelled surface 329. Similarly, first chute piece 322, comprises an angled backwall portion 352, forming an internal bevelled surface 343. The backwall portions 340 and 352 join to form a complete backwall for the chute 315. As shown in FIG. 9, each of the backwall portions 340 and 352 may comprise one-half of the complete backwall for the chute 315. Alternatively, the proportion of the complete backwall comprised by each of the backwall portions 340 and 352 may be varied. For example, the backwall portion 340 may be made larger than backwall portion 352 and may therefore comprise more than one-half of the complete backwall. Ridges 330 and 331 are formed on the backwall portions 340 and 352, respectively.

The wing-members 341 and 342 are integral with the backwall portions 352 and 340, respectively. The wing members 341 and 342 each project at an angle, respectively forming external bevelled surfaces 348 and 344. Support ribs 346 and 350 help support the wing members 342 and 341, respectively.

A technical advantage of the coin chute 315 is that it permits smooth separation of the chute pieces 322 and 23 when either the internal bevelled surfaces 329 and 343 or the external bevelled surfaces 344 and 348 are impacted by a foreign object.

Figure 10:
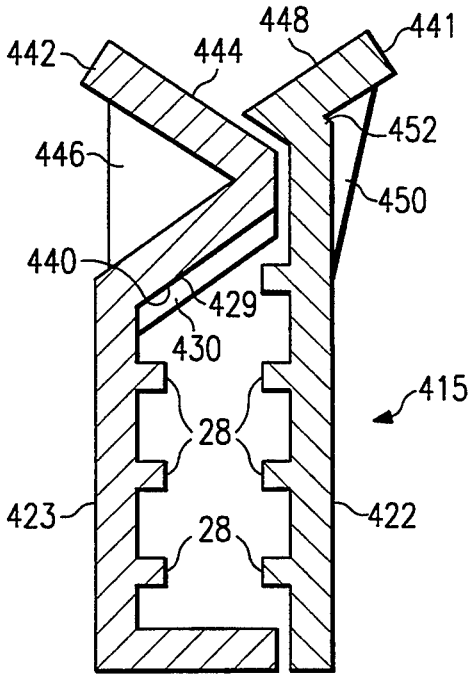
Figure 11:
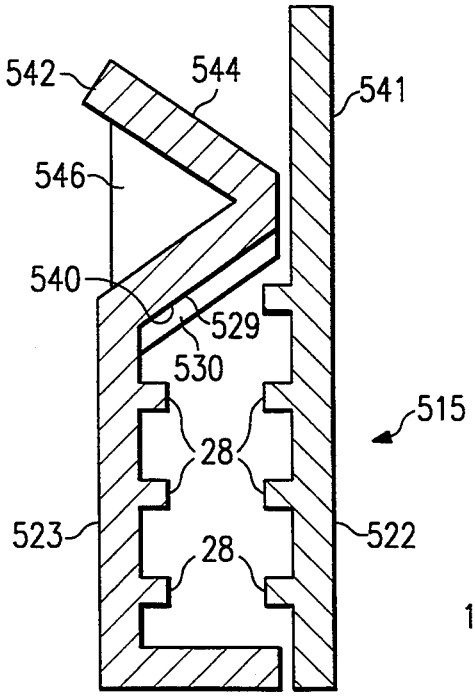

The coin chute 415 shown in FIG. 10 comprises first and second chute pieces 422 and 423. The second chute piece 423 is similar to the second chute piece 123 shown in FIG. 7. It comprises an angled backwall 440, forming an internal bevelled surface 429. A wing member 442 extends outwardly at an angle from the backwall 440, forming an external bevelled surface 444. A plurality of support ribs 446 helps support the connection of the wing member 442 to the backwall 440. Ridges 430, similar to ridges 130 shown in FIG. 6, are formed on the backwall 440.

The coin chute piece 422 comprises a rear portion 452, which extends from the rest of chute piece 422 in a direction toward the chute piece 423. Rear portion 452 runs generally parallel to and fits behind the wing member 442 of the chute piece 423 when the chute 415 is in a closed position. Extending in a direction away from the rear portion 452 is a wing member 441, forming an external bevelled surface 448. The connection of the wing member 441 to the rear portion 452 may be supported by a plurality of support ribs 450.

A technical advantage of the chute 415 is that it is particularly effective in preventing coins from inadvertently causing the separation of the chute pieces 422 and 423.

FIG. 11 shows a further alternative coin chute 515 comprising first and second chute pieces 522 and 523. The second chute piece 523 is similar to the second chute piece 123 shown in FIG. 7. Chute piece 523 comprises a backwall 540 extending from the rest of the chute piece 523 at an angle, forming an internal bevelled surface 529. A wing member 542 extends at an angle from the backwall 540, forming an external bevelled surface 544. A plurality of support ribs 546 help support the connection of the wing members 542 to the backwall 540. Ridges 530, similar to the ridges 130 shown in FIG. 6, are formed on the backwall 540.

The first chute piece 522 comprises an end portion 541 that is integral with and extends from the rest of the chute piece 522 without bending. A technical advantage of coin chute 515 is that it can be used in coin operated machines that have internal space constraints that prevent use of two bent chute pieces.

FIGS. 7 through 11 are included herein for the purpose of teaching various technical advantages of the present invention. The presentation of these embodiments should not be construed to limit the scope of the present invention to any specific embodiment.

Figure 12:
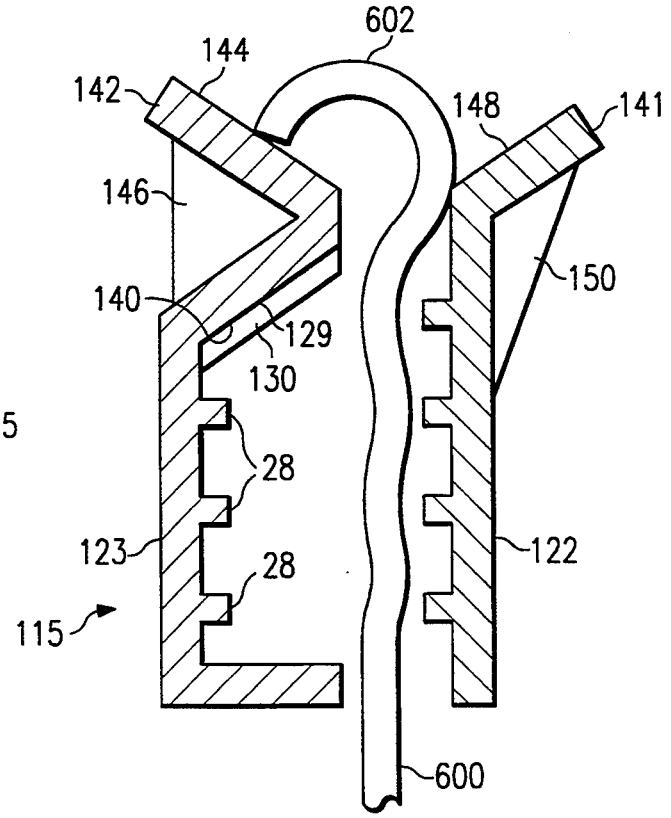
FIG. 12 is a view of the FIG. 7 chute, illustrating operation of the bevelled surface feature of the invention when a hook-type object is forced into the chute.

FIG. 12 illustrates the interaction of a hook-type object with coin chute 115, which was previously described with reference to FIG. 7. If an elongated foreign object 600 having a hook-end 602 is forced into coin chute 115, the chute pieces 122 and 123 separate upon impact of the hook-end 602 against the internal bevelled edge 129. The foreign object 600 thus travels harmlessly through the separated chute 115.

The external bevelled surfaces 144 and 148 prevent the hook-end 602 from becoming caught on a part of one of the chute pieces 122 or 123. The thief may cause damage to the chute 115 if he forcibly attempts to retrieve a foreign object 600 that has become caught on one of the chute pieces 122 or 123. Furthermore, if the thief is unable to retrieve the foreign object 600, the phone becomes inoperable for future users, who will probably also be unable to withdraw the foreign object 600. The phone will thus require servicing.

The external bevelled surfaces 144 and 148 reduce the possibility of having the hook-end 602 of the foreign object 600 becoming caught on the outside of the chute pieces 122 and 123. If the hook-end 602 is forced against the outside of the coin chute 115, the bevelled surfaces 144 and 148 will cause the chute 115 to separate, allowing continued movement and eventual removal of the foreign object 600. The foreign object 600 can thus be removed without causing damage to the chute 115.

Although the present invention has been described in detail, it should be understood that various changes, substitutions and alterations can be made hereto without departing from the spirit and scope of the invention as defined by the appended claims.

What is claimed is:

1. A coin handling system, comprising:

first and second chute piece biased together to form a coin chute having an opening for receiving a coin;

a backwall formed on one of said chute pieces;

an exterior bevel surface outside said coin chute, integral with said backwall, and bevelled toward an interior of said coin chute such that said chute pieces separate if said exterior bevel surface is impacted by a foreign object.

2. The coin handling system of claim 1, and further comprising snaring means disposed in said backwall for preventing downward movement of foreign objects forced into said chute.

3. The coin chute of claim 2, wherein said snaring means comprises ridges formed on said backwall.

4. The coin chute of claim 2, wherein said snaring means comprises grooves formed in said backwall.

5. The coin chute of claim 2, wherein said snaring means comprises slots formed in said backwall.

6. The coin chute of claim 2, wherein said chute forms a general "L" shape.

* * * * *